United States Patent [19]

Ito

[11] 4,157,873

[45] Jun. 12, 1979

[54] DOT PRINTING APPARATUS

[75] Inventor: Minoru Ito, Tokyo, Japan

[73] Assignee: Ricoh Co., Ltd., Tokyo, Japan

[21] Appl. No.: 858,057

[22] Filed: Dec. 6, 1977

[30] Foreign Application Priority Data

Dec. 7, 1976 [JP] Japan ..... 51/146106

[51] Int. Cl.[2] ..... B41J 3/10

[52] U.S. Cl. ..... 400/124; 101/93.05; 335/274

[58] Field of Search ..... 101/93.05; 400/124; 335/255, 257, 258, 271, 274

[56] References Cited

U.S. PATENT DOCUMENTS

| | | | |
|---|---|---|---|
| 3,755,700 | 8/1973 | Buschmann et al. | 400/124 X |
| 3,787,791 | 1/1974 | Borger et al. | 400/124 X |
| 3,940,726 | 2/1976 | Gershnow | 400/124 X |
| 4,016,965 | 4/1977 | Wirth et al. | 400/124 |
| 4,034,841 | 7/1977 | Ohyama et al. | 400/124 |
| 4,037,704 | 7/1977 | Golobay et al. | 400/124 |
| 4,061,219 | 12/1977 | Nishikawa et al. | 400/124 |

*Primary Examiner*—Paul T. Sewell

*Attorney, Agent, or Firm*—Frank J. Jordan

[57] ABSTRACT

A ferromagnetic core fixed to an end of a wire is electromagnetically attracted such that the core and wire are axially moved so that the free end of the wire strikes paper through a ribbon to print a dot. A leaf spring returns the core and wire to a standby position in which the core abuts against a stopper and the leaf spring is resiliently deformed. A washer having an annular axially extending projection is urged by a compression spring against a spring seat, thereby urging the spring seat against a shoulder of a housing. The leaf spring is disposed in an annular gap between the washer and spring seat. The washer serves the dual function of preventing movement and frictional abrasion of the spring seat and absorbing impact energy of the core against the stopper upon axial wear of the core and stopper.

2 Claims, 4 Drawing Figures

DOT PRINTING APPARATUS

BACKGROUND OF THE INVENTION

The present invention relates to an improved dot printing element or apparatus which may be used either singly or in combination with other dot printing elements to form a dot matrix.

A prior art dot printing element to which the present invention constitutes a novel improvement comprises a housing in which is provided an electromagnetic coil. A ferromagnetic core is fixed to an end of a wire and is magnetically attractable by the core to move the free end of the wire into impact with paper through a ribbon to print a dot. The printing element may be steppingly moved to print a line of a dot matrix or may be combined with similar elements to print an entire character in, for example, a 5×7 dot matrix configuration.

A leaf spring fixed to the core is urged into engagement with a shoulder of a housing in which the coil and core are provided and returns the core and wire to a standby position after printing engagement with the paper. More specifically, the core is urged by the leaf spring into abutment with a stopper. The stopper is adjusted so that a preload is normally provided to the spring. A spring seat is provided between the shoulder of the housing and the leaf spring.

Over a period of use, the constant impact between the core and stopper causes wear of both components such that the preload of the leaf spring constantly decreases. Such impact causes cold working and shortening of the core and, to a lesser extent, the stopper. After a period of time the wear becomes so great that the preload of the leaf spring is reduced to zero and the spring seat, leaf spring and core are in a free state between the soulder of the housing and the stopper. Vibration of the apparatus during operation under these conditions causes the spring seat to axially move back and forth, thereby creating wear and the production of particles due to frictional abrasion. These particles intercede into the spaces between the stopper, core, leaf spring, spring seat and shoulder of the housing and interfere with the movement of the core and wire. Although these problems may be reduced by increasing the initial preload on the leaf spring, such is only a temporary solution. The amount of preload increase is furthermore limited since excessive preload will prevent the wire from moving through a sufficient distance and with sufficient velocity to print a dot on the paper.

SUMMARY OF THE INVENTION

The above described problems of the prior art are overcome by the present invention by providing a washer between the stopper and spring seat. The washer has an annular, axially extending projection of a diameter and thickness larger than the leaf spring. A compression spring urges the washer so that the projection thereof engages the spring seat and maintains the same in engagement with the shoulder of the housing. The leaf spring is disposed in an annular space between the spring seat and the washer in such a manner that the washer acts to absorb impact energy of the core against the stopper when the core and stopper have worn beyond a predetermined extent.

It is an object of the present invention to provide a dot printing element or apparatus in which a major cause of malfunction due to wear is eliminated.

It is another object of the present invention to provide a dot printing element comprising a novel washer and spring which serve the dual function of preventing movement and frictional abrasion of a spring seat and absorbing impact energy after various components have worn beyond a certain extent.

It is another object of the present invention to provide a generally improved dot printing apparatus.

Other objects, together with the foregoing, are attained in the embodiment described in the following description and illustrated in the accompanying drawing.

DESCRIPTION OF THE PREFERRED EMBODIMENT

While the dot printing apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
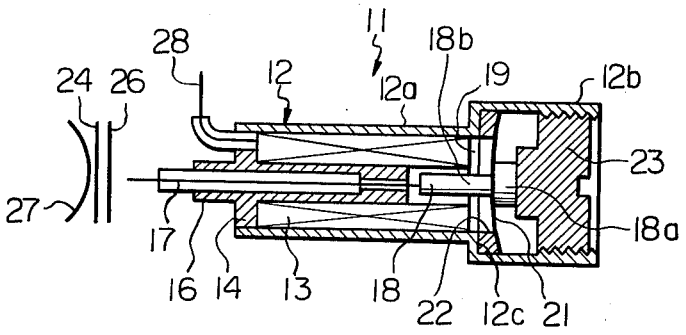
Fig. 1 PRIOR ART
FIG. 1 is longitudinal sectional view of a prior art dot printing apparatus in a new condition.

Referring now to FIG. 1 of the drawing, a prior art dot printing element or apparatus is generally designated by the reference numeral 11 and comprises a housing 12. The housing 12 is tubular and is formed with a small diameter section 12*a* and a large diameter section 12*b* which are joined at a shoulder 12*c*. An electromagnetic coil 13 is provided in a bore (no numeral) of the housing section 12*a*. A wall 14 is provided to the left end of the housing 12 and is integral with a guide sleeve 16 which is coaxially surrounded by the coil 13. A printing wire 17 is slidably supported by the guide sleeve 16 for axial movement. A ferromagnetic core 18 is formed with a large diameter section 18*a* and a small diameter section 18*b* which is fixed to the right end of the wire 17 and is partially surrounded by the coil 13. A partition 19 slidably supports the core 18.

A leaf spring 21 is fixed to the core 18 and resiliently engages the shoulder 12*c* of the housing 12 through a spring seat 22. A stopper 23 which is screwed into the right end portion of the housing 12 normally engages the right end of the section 18*a* of the core 18 and urges the core 18 and leaf spring 21 leftwardly so that the leaf spring 21 is in a preloaded state exerting a rightward force on the core 18 and thereby the wire 17.

The left end of the wire 17 extends externally of the housing 12 and faces a sheet of paper 24 for printing. An inked ribbon 26 and a platen 27 are provided on the left and right sides of the paper 24 respectively.

In operation, a pulse of electric current is applied to the coil 13 through leads 28. This creates an electromagnetic force which attracts the core 18 further into the coil 13 and moves the core 18 and wire 17 leftwardly so that the left end of the wire 17 impacts against the paper 24 through the ribbon 26, thereby printing a dot. During this operation, the leaf spring 21 is further deformed.

Subsequent to printing the dot, the impact force of the wire 17 against the paper 24 in combination with the force of the leaf spring 21 urges the core 18 and wire 17 rightwardly until the right end of the section 18a of the core 18 abuts against the stopper 23 and is maintained in this standby position by the leaf spring 21 in preparation for printing another dot. It will be understood that drive means which are not shown step the element 11 in a linear manner to progressively print a line of a dot matrix.

Figure 2:
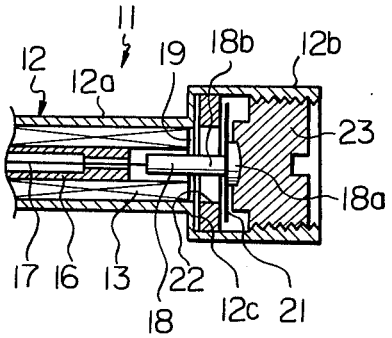
Fig. 2 PRIOR ART
FIG. 2 is similar to FIG. 1 but shows the prior art apparatus in a worn condition.

The continued impact of the core 18 against the stopper 23 causes the core 18 and stopper 23 to wear in the axial direction. This wear is due to cold working and abrasion. Whereas the initial preload of the leaf spring 21 is set at 10 to 30 grams at the time of manufacture, the continued wear causes the preload to progressively decrease to zero. FIG. 2 illustrates the case where the wear has increased to such an extent that the leaf spring 21, core 18 and spring seat 22 are actually in a free or unloaded state between the shoulder 12c and the stopper 23. This allows the spring seat 22 to axially move due to vibration and the like and abrade itself and the conjugate surface of the housing section 12*b*. Particles generated by abrasion of the spring seat 22, core 18 and stopper 23 intercede into the various gaps, interfere with the movement of the core 18 and wire 17 and increase the rate of abrasion.

Figure 3:
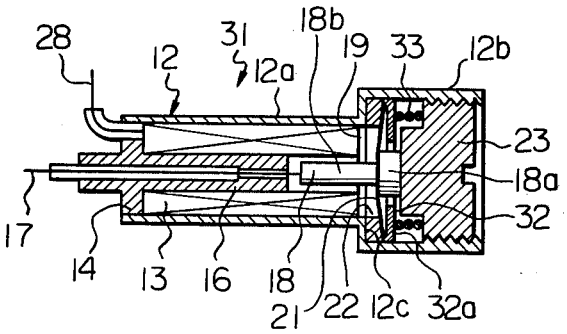
FIG. 3 is a longitudinal sectional view of a dot printing apparatus embodying the present invention in a new condition.
Figure 4:
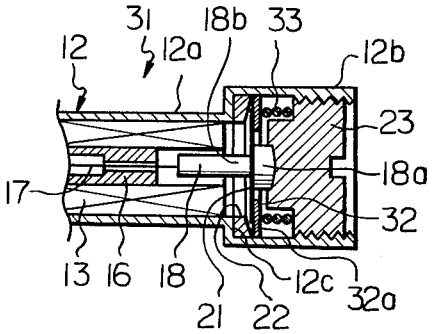
FIG. 4 is similar to FIG. 3 but shows the present apparatus in a worn condition.

This problem is completely overcome by the present invention as illustrated in FIGS. 3 and 4. The present dot printing apparatus is designated as 31. However, elements which are essentially similar to those of the prior art apparatus 11 are designated by the same reference numerals.

In accordance with the present invention, in the apparatus 31 a washer 32 is provided between the spring seat 22 and stopper 23. The washer 32 has a central hole (not designated) through which the core 18 extends. The washer 32 is further formed with an annular, axially extending projection 32*a* which engages the right surface of the spring seat 22. A compression spring 33 provided between the stopper 23 and the washer 32 in a loaded state urges the washer 32 and spring seat 22 against the shoulder 12*c* of the housing 12.

The annular projection 32*a* has a diameter greater than that of the leaf spring 21. Furthermore, the annular projection 32*a* has a thickness greater than that of the leaf spring 21. In other words, the leaf spring 21 is disposed in an annular gap (not designated) between the left face of the washer 32 and the right face of the spring seat 22 which has an axial dimension greater than the thickness of the leaf spring 21. Typically, the thickness of the annular projection 32*a* is selected to be greater than the thickness of the leaf spring 21 by approximately 0.1 mm. If the stopper 23 were removed, the leaf spring 21 would be free to move axially by a distance of 0.1 mm between the spring seat 22 and washer 32.

The compression spring 33 acting through the washer 32 maintains the spring seat 22 in constant engagement with the shoulder 12*c* regardless of the amount of wear of the core 18 and stopper 23. This eliminates the production of particles by frictional abrasion between the spring seat 22 and housing section 12*b*.

Although the preload of the leaf spring 21 is reduced to zero after prolonged use of the apparatus 31 as illustrated in FIG. 4, the washer 32 greatly decreases the amount of wear after this point. More specifically, when the wear has progressed to the point where, with the leaf spring 21 in its free state, the axial play between the core 18 and stopper 23 exceeds 0.1 mm the washer 32 acts as an impact absorber to cushion the impact of the core 18 against the stopper 23 after printing a dot. Before the core 18 hits the stopper 23, the leaf spring 21 engages the left face of the washer 32. During further movement of the core 18 toward the stopper 23 from this point, the leaf sring 21 is resiliently deformed, exerting a leftward force on the core 18. This decelerates the core 18 so that the impact velocity thereof against the stopper 23 is greatly reduced. This arrangement effectively prevents the axial play between the core 18 and stopper 23 from substantially exceeding 0.1 mm.

In summary, it will be seen that the present invention provides, as a novel and unique improvement to a dot printing element or apparatus, an arrangement of a washer and a spring which serve the combined functions of preventing axial movement and wear of a spring seat and absorbing impact energy of a core against a stopper, thereby greatly reducing wear of the moving parts of the apparatus. Various modifications will become possible for those skilled in the art after receiving the teachings of the present disclosure without departing from the scope thereof.

What is claimed is:

1. A dot printing apparatus comprising:

a housing formed with a bore;

a dot printing wire axially slidably received in the bore, a first end of the wire extending external of the housing;

a ferromagnetic core fixed to a second opposite end of the wire;

an electromagnetic coil operatively positioned relative to the core such that electrical energization thereof attracts and axially moves the core and wire such that the first end of the wire extends further from the housing to print a dot;

a leaf spring fixed to the core for urging the core and wire toward retraction into the housing, the leaf spring normally resiliently engaging a shoulder of the housing;

a stopper normally engaging the core and urging the same so as to deform the leaf spring to resiliently engage the shoulder of the housing;

an annular washer provided between the stopper and the shoulder of the housing, the core extending through the washer, the washer being formed with an annular, axially extending shoulder having a diameter greater than a diameter of the leaf spring and a thickness greater than a thickness of the leaf spring, the leaf spring being disposed between the washer and the shoulder of the housing; and a compression spring provided between the stopper and the washer urging the washer so that the annular shoulder thereof engages the shoulder of the housing.

2. An apparatus as in claim 1, further comprising a spring seat provided between the leaf spring and the shoulder of the housing, the leaf spring and annular shoulder of the washer engaging the shoulder of the housing through the spring seat.

* * * * *